US006148973A

United States Patent [19]

Chang

[11] Patent Number: 6,148,973

[45] Date of Patent: Nov. 21, 2000

[54] FRAME OF A CLOTH-SHELLED LUGGAGE ARTICLE

[76] Inventor: Ruey-Yang Chang, P.O. Box 453, Taichung, Taiwan

[21] Appl. No.: 09/357,946

[22] Filed: Jul. 21, 1999

[51] Int. Cl.[7] ..... A45C 5/14; A45C 13/36

[52] U.S. Cl. ..... 190/127; 190/18 A; 190/39; 190/115

[58] Field of Search ..... 190/18 A, 115, 190/122, 127; 280/37

[56] References Cited

U.S. PATENT DOCUMENTS

| | | | |
|---|---|---|---|
| 1,895,677 | 1/1933 | Pinheiro | 190/18 A |
| 2,755,896 | 7/1956 | Breglia | 190/115 |
| 3,104,740 | 9/1963 | Koffler | 190/115 |
| 5,295,565 | 3/1994 | Latshaw | 190/18 A |
| 5,474,162 | 12/1995 | Shyr et al. | 190/115 X |
| 5,653,319 | 8/1997 | Wang | 190/115 |

FOREIGN PATENT DOCUMENTS

| | | | |
|---|---|---|---|
| 619686 | 3/1949 | United Kingdom | 190/127 |

*Primary Examiner*—Sue A. Weaver
*Attorney, Agent, or Firm*—Harrison & Egbert

[57] ABSTRACT

A cloth-shelled luggage article includes a top bracing plate, a bottom bracing plate, two support tubes, an expandable pull rod frame, and at least one caster. The expandable pull rod frame is securely held by the top bracing plate and the bottom bracing plate. The two support tubes are disposed between the top bracing plate and the bottom bracing plate for securing the top bracing plate and the bottom bracing plate in place.

4 Claims, 7 Drawing Sheets

FRAME OF A CLOTH-SHELLED LUGGAGE ARTICLE

FIELD OF THE INVENTION

The present invention relates generally to a luggage article, and more particularly to a frame of a luggage article having a shell made of cloth.

BACKGROUND OF THE INVENTION

As shown in FIG. 1, a cloth-shelled luggage article 10 of the prior art has an upper wooden plate 11, a lower wooden plate 12, and a frame 13 located between the upper wooden plate 11 and the lower wooden plate 12.

Such a prior art luggage article 10 as described above is defective in design in that it can not be easily assembled, and that the front side of the luggage article 10 is prone to collapse by the weight of the luggage article 10 in light of an expandable rod frame 14 being mounted in the rear side of the luggage article 10. In addition, the expandable rod frame 14 comprises an upper seat 141 and a lower seat 142. The upper seat 141 is fastened to the upper wooden plate 11, whereas the lower seat 142 is fastened to the lower wooden plate 12. Such an expandable rod frame 14 as described above is incapable of providing the luggage article 10 with a structural stability. Moreover, the prior art luggage article 10 has a plurality of right-angled corners which undermine the appearance of the prior art luggage article 10. The bottom corners of the rear side of the luggage article 10 are covered with cloth and can not be therefore provided with casters in conjunction with the expandable rod frame 14.

SUMMARY OF THE INVENTION

The primary objective of the present invention is to provide a cloth-shelled luggage article with a frame which is so designed to provide the luggage article with arcuate corners to enhance the appearance of the luggage article.

It is another objective of the present invention to provide a cloth-shelled luggage article with a frame which is so designed to facilitate the mounting of casters at the bottom corners of the rear side of the luggage article. The casters are mounted in such a manner that they cooperate with an expandable rod frame of the luggage article.

The foregoing objectives, features and functions of the present invention will be more readily understood upon a thoughtful deliberation of the following detailed description of the embodiments of the present invention with reference to the accompanying drawings.

DETAILED DESCRIPTION OF THE EMBODIMENTS

Figure 1:
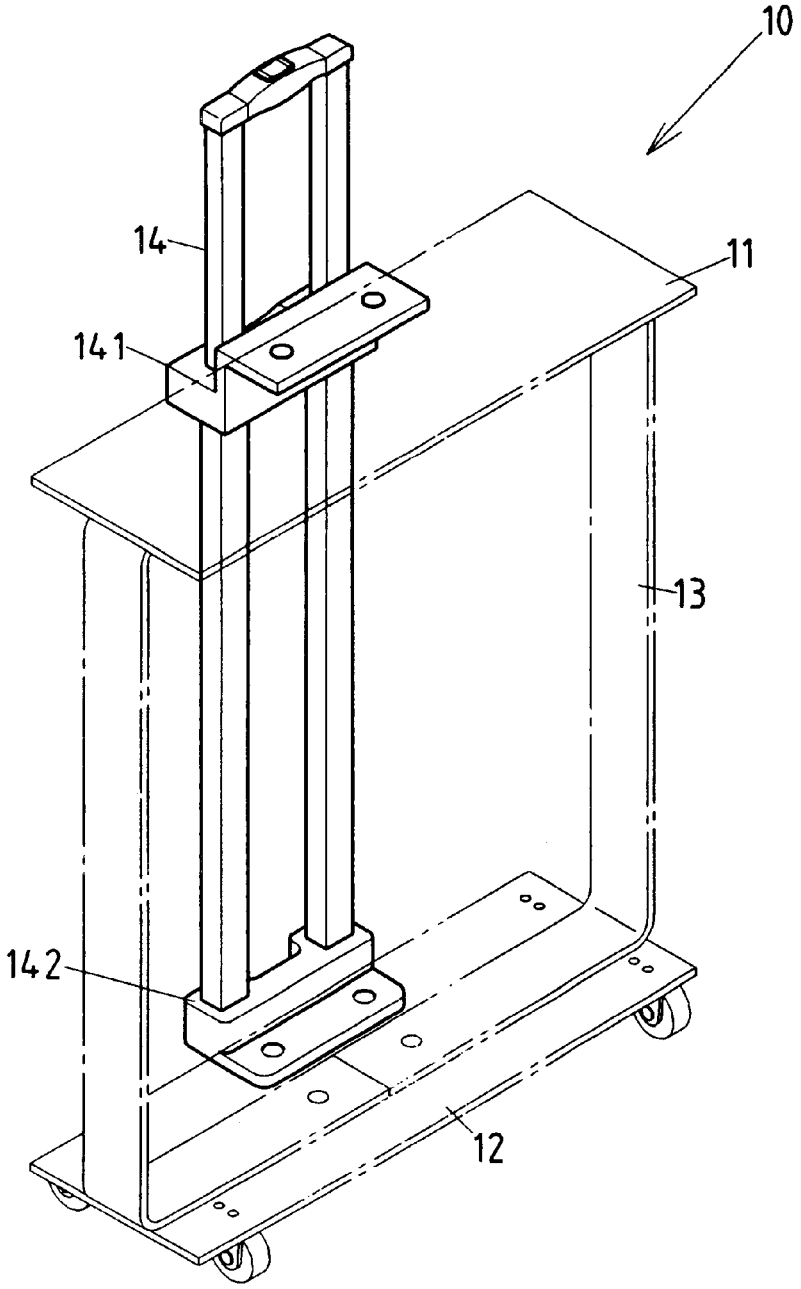
FIG.1 PRIOR ART
FIG. 1 shows a perspective view of a cloth-shelled luggage article of the prior art.
Figure 2:
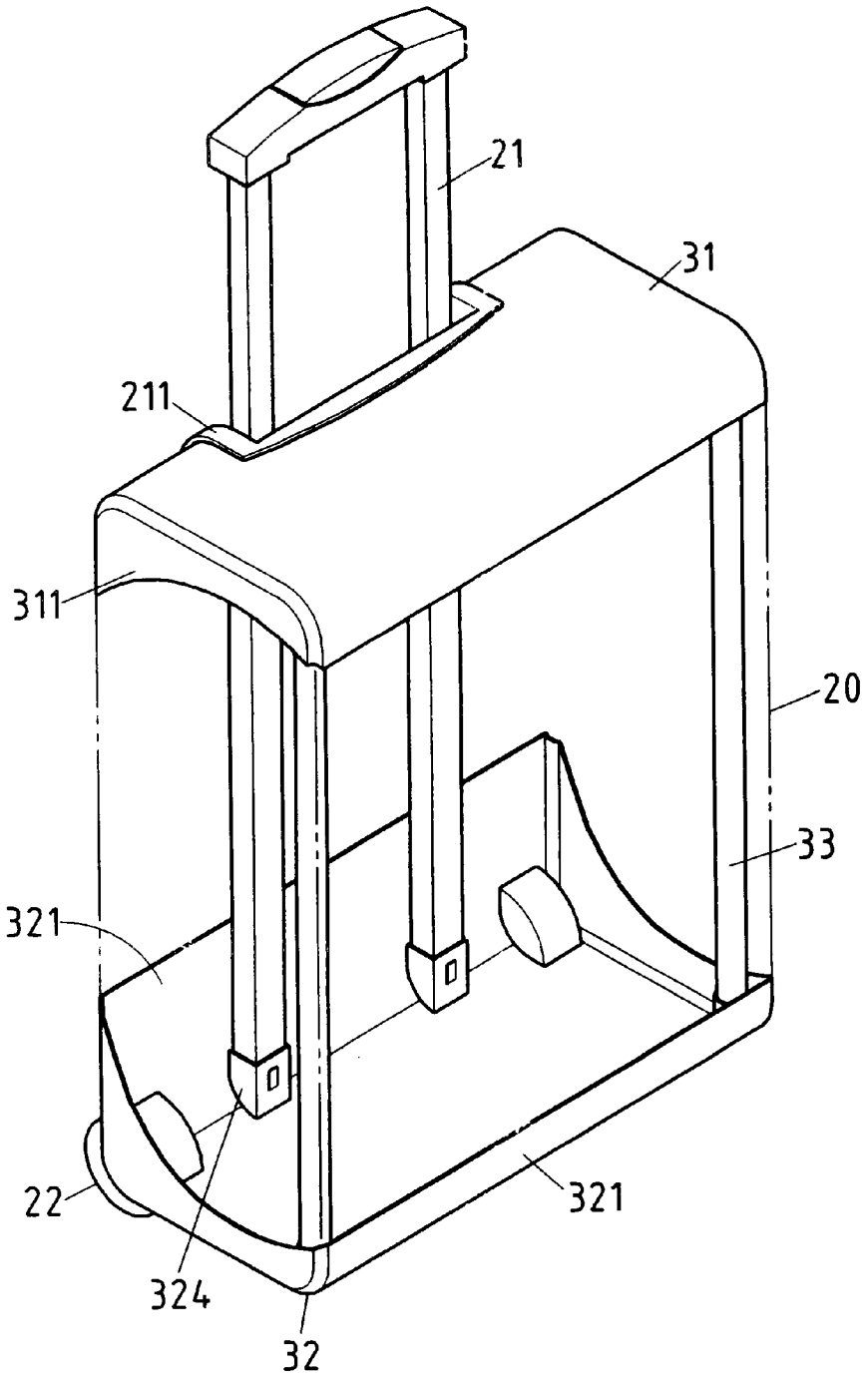
FIG. 2 shows a perspective view of a cloth-shelled luggage article of the present invention.
Figure 3:
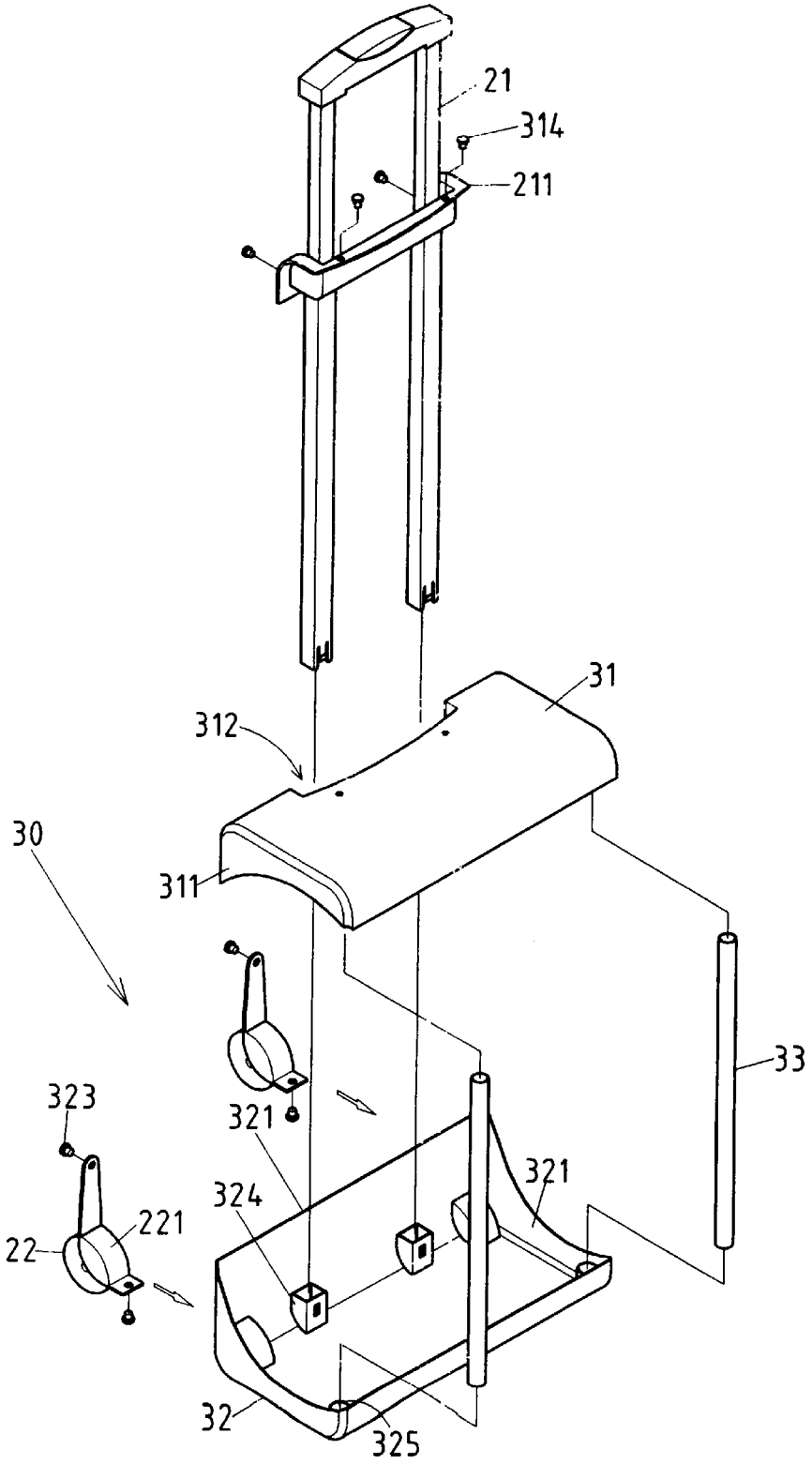
FIG. 3 shows an exploded view of the cloth-shelled luggage article of the present invention as shown in FIG. 2.
Figure 4:
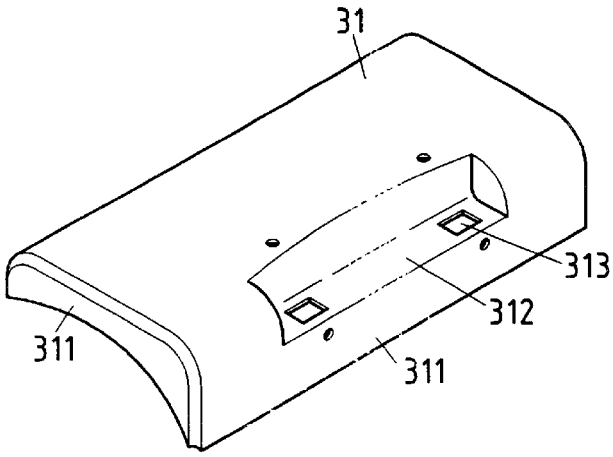
FIG. 4 shows a schematic view of a top bracing plate of the present invention.
Figure 5:
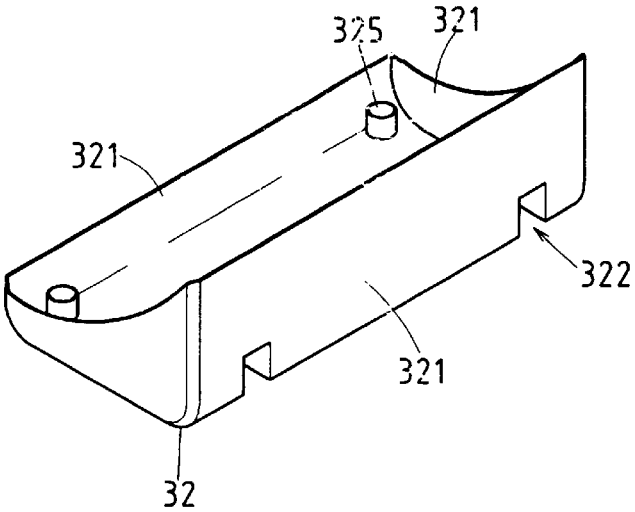
FIG. 5 shows a schematic view of a bottom bracing plate of the present invention.

As shown in FIGS. 2 and 3, a cloth-shelled luggage article 20 embodied in the present invention comprises mainly a frame 30, an expandable pull rod frame 21, and a plurality of corner casters 22.

The frame 30 is formed of a top bracing plate 31, a bottom bracing plate 32, and two support tubes 33. The top bracing plate 31 and the bottom bracing plate 32 are made of a plastic material by injection molding.

Figure 6:
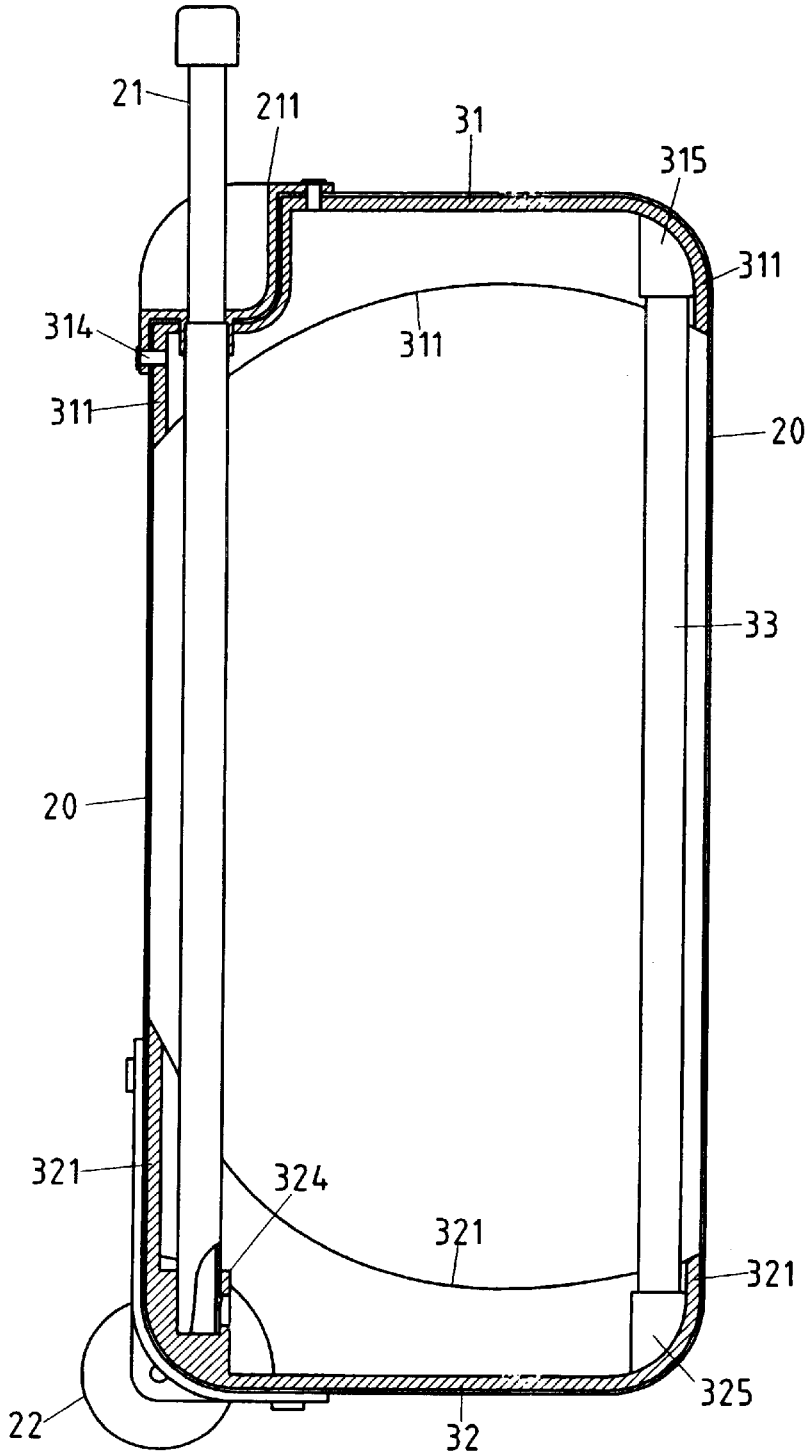
FIG. 6 shows a longitudinal sectional view of the present invention in combination.

The top bracing plate 31 is provided at both longitudinal ends thereof with a support side 311, and in the rear longitudinal side thereof with a cut 312 in which a top seat 211 of the expandable pull rod frame 21 is secured by a plurality of rivets 314. The top bracing plate 31 is further provided in the underside of the front side thereof with two tube seats 315, as shown in FIG. 6.

The bottom bracing plate 32 is provided with a plurality of support sides 321, and recesses 322 in which the caster casing 221 is fastened by a plurality of rivets 323. The bottom bracing plate 32 is further provided with two slotted seats 324 for receiving two bottom ends of the expandable pull rod frame 21, and two tube seats 325 corresponding in location to the two tube seats 315 of the top bracing plate 31.

The two support tubes 33 are disposed between the top bracing plate 31 and the bottom bracing plate 32 such that the top ends of the two support tubes 33 are retained in the two tube seats 315 of the top bracing plate 31, and that the bottom ends of the two support tubes 33 are retained in the two tube seats 325 of the bottom bracing plate 32.

The top bracing plate 31 and the bottom bracing plate 32 are provided with four arcuate corners.

Figure 7:
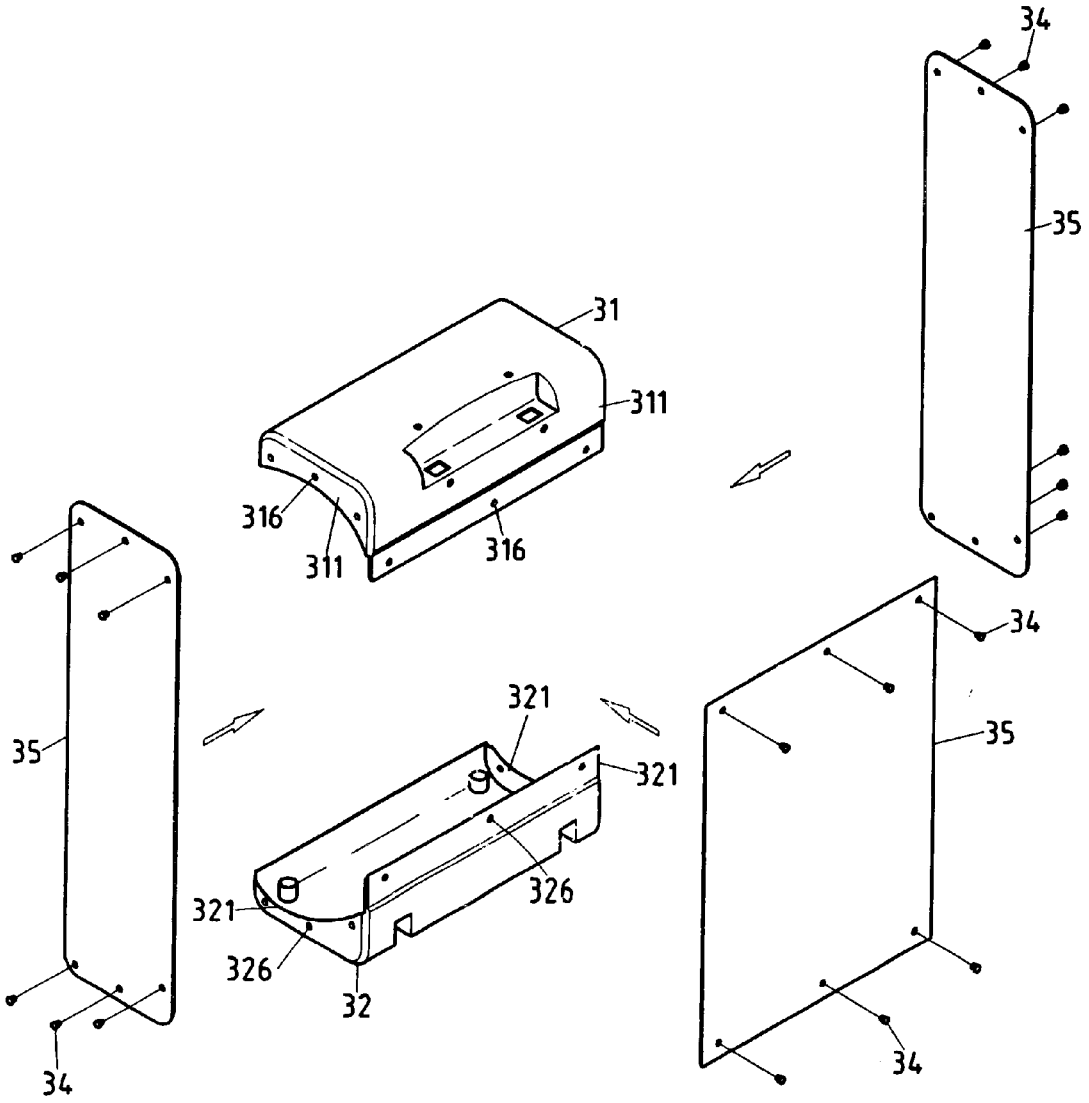
FIG. 7 shows an exploded view of a top bracing plate and a bottom bracing plate of another preferred embodiment of the present invention.
Figure 8:
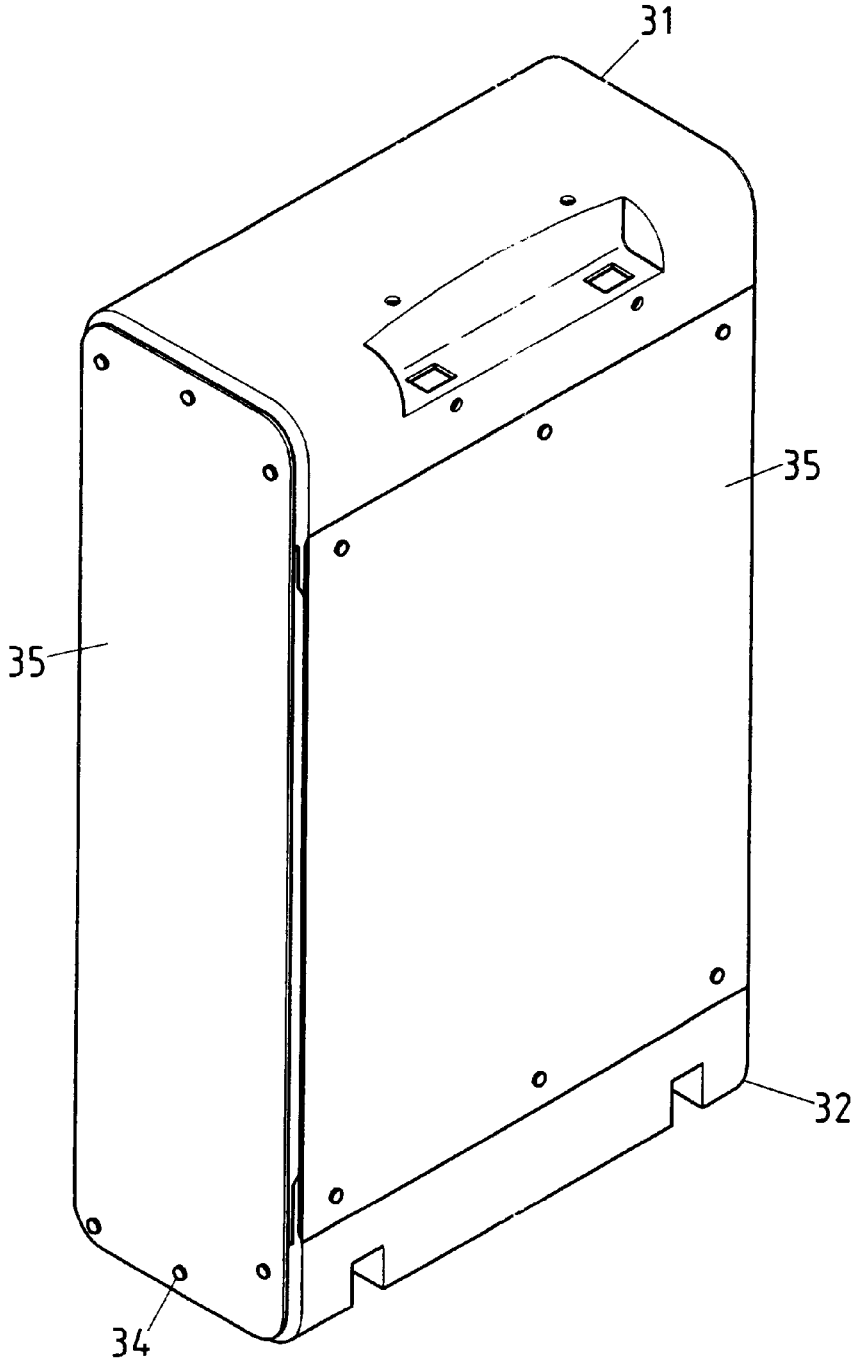
FIG. 8 shows a perspective view of another preferred embodiment of the present invention in combination.

As shown in FIGS. 7 and 8, the support sides 311 of the top bracing plate 31 are provided with a plurality of holes 316, whereas the support sides 321 of the bottom bracing plate 32 are provided with a plurality of holes 326. These holes 316 and 326 are used along with rivets 34 to fasten two support plates 35 to the top bracing plate 31 and the bottom bracing plate 32 for reinforcing the structure of the cloth-shelled luggage article 20 of the present invention. The support plates 35 are made of polyethylene (PE).

The cloth-shelled luggage article 20 of the present invention has advantages over the cloth-shelled luggage article 10 of the prior art. For example, the top bracing plate 31 and the bottom bracing plate 32 of the present invention can be made by injection molding in quantity. The structural strength of the cloth-shelled luggage article 20 of the present invention is significantly enhanced by the support sides 311 of the top bracing plate 31 and the support sides 321 of the bottom bracing plate 32. The luggage article 20 of the present invention is provided with a plurality of casters 22 which are fastened at the corners of the rear bottom side of the bottom bracing plate 32. The construction of the cloth-shelled luggage article 20 of the present invention is reinforced by the expandable pull rod frame 21, two support tubes 33, and two PE plates 35.

The embodiments of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A cloth-shelled luggage article article comprising:

a top bracing plate having two support sides, said top bracing plate being two tube seats formed at an underside thereof and adjacent a forward edge thereof, said top bracing plate having a cut-out area at the back edge thereof;

a bottom bracing plate having a plurality of support sides, said bottom bracing plate having recesses formed adjacent a back edge thereof, said bottom bracing plate having two slotted seats formed on a top surface thereof, said bottom bracing plate having two tube seats formed on a top surface thereof, said two tube seats of said bottom bracing plate vertically aligned with said two tube seats of said top bracing plate;

an expandable pull rod frame having a top seat secured by a plurality of rivets within said cut-out area of said top bracing plate, said expandable pull rod frame having two bottom ends respectively received within said two slotted seats of said bottom bracing plate;

two support tubes having respective top ends retained within said two tube seats of said top bracing plate, said two support tubes having respective bottom ends retained within said two tube seats of said bottom bracing plate, said two support tubes being disposed between said top bracing plate and said bottom bracing plate; and a plurality of casters respectively affixed within said recesses of said bottom bracing plate.

2. The article of claim 1, each of said top bracing plate and said bottom bracing plate having four arcuate corners.

3. The article of claim 1, said top bracing plate and said bottom bracing plate having a plurality of holes formed respectively therein, the article further comprising:

two support plates respectively fastened by a plurality of rivets to said plurality of holes on opposite sides of said top and bottom bracing plates.

4. The article of claim 3, said two support plates being formed of polyethylene material.

* * * * *